United States Patent [19]

Carpenter et al.

[11] Patent Number: 4,854,432

[45] Date of Patent: Aug. 8, 1989

[54] SUITCASE HAVING REMOVABLE DIVIDER WITH CLOTHING POCKETS

[75] Inventors: Lester E. Carpenter, Middletown; Charles E. Waddell, Jr., Bristol, both of R.I.

[73] Assignee: American Tourister, Inc., Warren, R.I.

[21] Appl. No.: 215,556

[22] Filed: Jul. 6, 1988

[51] Int. Cl.[4] ..... A45C 3/12; A45C 13/02; A45C 13/04

[52] U.S. Cl. ..... 190/110; 190/111; 190/127

[58] Field of Search ..... 190/13 F, 109–111, 190/127, 108, 115; 206/287; 150/113; 383/10

[56] References Cited

U.S. PATENT DOCUMENTS

| | | | |
|---|---|---|---|
| 2,536,169 | 1/1951 | Gray | 190/110 X |
| 2,673,756 | 3/1954 | Axtell | 190/109 X |
| 2,937,728 | 5/1960 | Koffler | 190/110 |
| 3,137,374 | 6/1964 | Holtzman | 190/110 |
| 3,263,779 | 8/1966 | Bialer | 190/110 |
| 3,306,404 | 2/1967 | Yellin | 190/110 |
| 3,306,405 | 2/1967 | Rosenblum | 190/110 |
| 3,448,839 | 6/1969 | Lugash | 190/111 X |
| 3,512,621 | 5/1970 | Teetor | 206/287 |
| 4,383,142 | 5/1983 | Kaneko | 190/127 X |
| 4,753,342 | 6/1988 | Pulichino, Jr. et al. | 190/13 F |

FOREIGN PATENT DOCUMENTS

| | | | |
|---|---|---|---|
| 3528862 | 2/1987 | Fed. Rep. of Germany | 190/110 |
| 2007193 | 5/1979 | United Kingdom | 190/109 |

*Primary Examiner*—Sue A. Weaver

*Attorney, Agent, or Firm*—Wood, Herron & Evans

[57] ABSTRACT

A suitcase is a hollow box having a hollow lid hinged thereto. A divider is stretched across the lid and removably secured to the lid on one side with Velcro fasteners and hooks and rings on the other side. The divider has multiple pockets on each side for clothing articles and accessories.

2 Claims, 2 Drawing Sheets

SUITCASE HAVING REMOVABLE DIVIDER WITH CLOTHING POCKETS

This invention relates to a suitcase and more particularly to a suitcase having a divider across the suitcase lid. While the invention is suitable for soft luggage as well as hard-sided luggage, it will be described in connection with a hard-sided suitcase.

Hard-sided suitcases consist of a hollow box and a hollow lid hinged to the box. It is known to hinge a divider across the lid of such a suitcase, the divider having rings on its free edge to be received in hooks along the edge of the lid to hold the clothing in the lid in place after the suitcase has been packed. It has also been known to form a pocket in such a divider for clothing articles or laundry or the like.

An objective of the present invention has been to provide a suitcase with a divider and to significantly augment the function of the divider.

This objective of the invention has been attained by providing two innovations.

First, the divider has multiple pockets on each side so that the divider becomes an organizer for clothing and accessories. Second, the divider is removably hinged to the lid by Velcro fasteners so that it can be removed from the suitcase for convenience of packing, unpacking and even temporary elimination from the suitcase where additional space is required. In this way, the utilization of the organizer pockets is enhanced, for the user need not be in any way impeded by the suitcase structure while performing the packing and unpacking of the organizer pockets. Thus, there is versatility provided by the divider--pack or unpack with the divider in the suitcase; pack or unpack with the divider removed from the suitcase; and use the divider to provide a storage function.

Referring more particularly to the organizer pockets, the divider preferably has a large zippered pocket covering substantially all of one side of the divider. The zippered pocket is preferably gusseted to comfortably receive shirts, sweaters and unexpected extras.

On the other side of the divider, at the lower half, two pockets having elastic facing openings are provided for snugly carrying one pair of shoes, the shoes being carried in such a way that dirty soles will remain out of contact with the clothing in the suitcase. Those pockets can alternatively be used for carrying several pairs of socks.

Also, on the other side of the divider at the upper half is a zippered pocket for carrying accessories.

The divider is preferably formed by providing a rigid, generally rectangular frame onto which a two-ply fabric is stitched. The pockets are mounted on the two-ply fabric. At the bottom edge of the divider is a rigid fabric-encased strip having the mating Velcro fasteners adhesively secured to it.

It will be appreciated that the divider portion of the present invention can be used as an independent softside unit. For example, it would be carried in an automobile independent of the suitcase.

The several objectives and features of the invention will become more readily apparent from the following detailed description taken in conjunction with the accompanying drawings in which.

Figure 1:
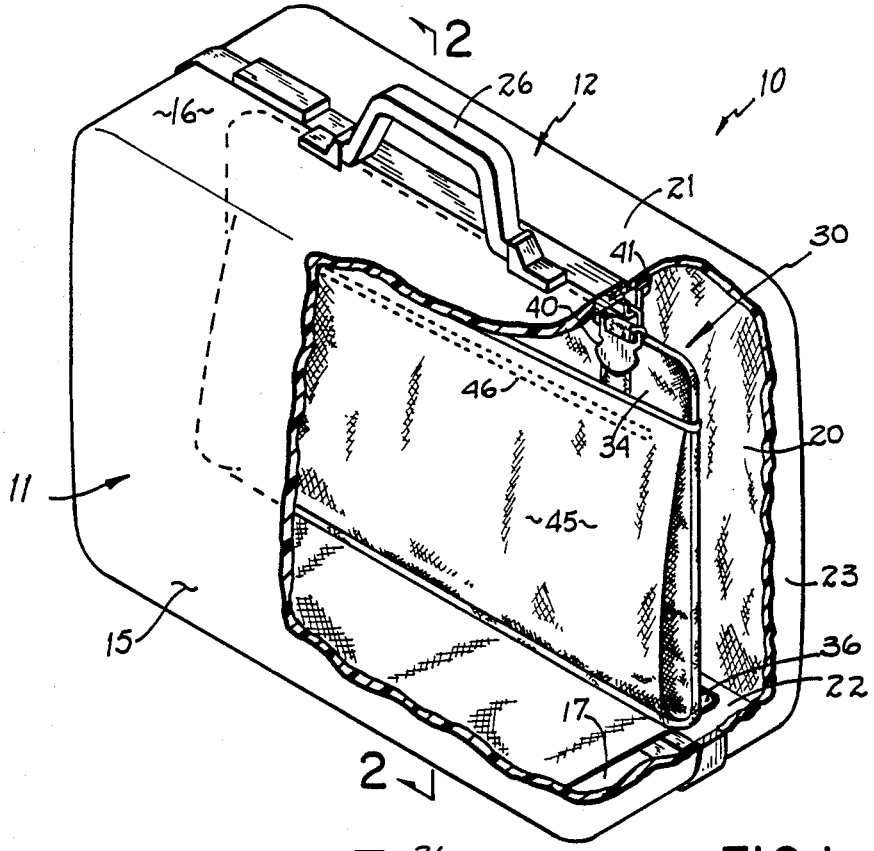
FIG. 1 is a perspective view of the suitcase of the present invention, the view being partly broken away to show the divider.
Figure 2:
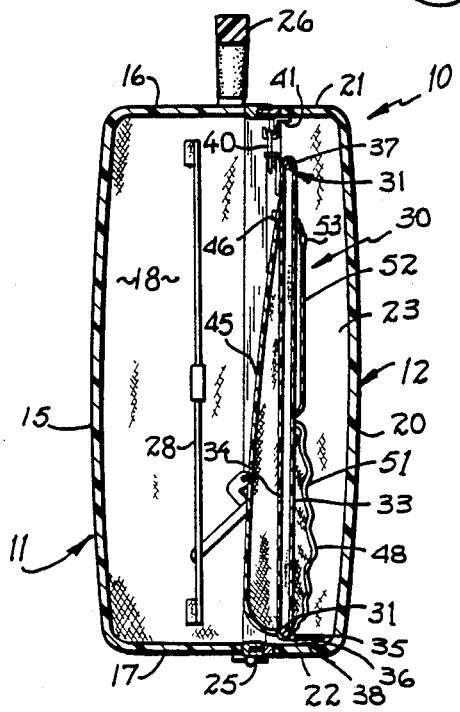
FIG. 2 is a cross-sectional view taken along lines 2—2 of FIG. 1.
Figure 3:
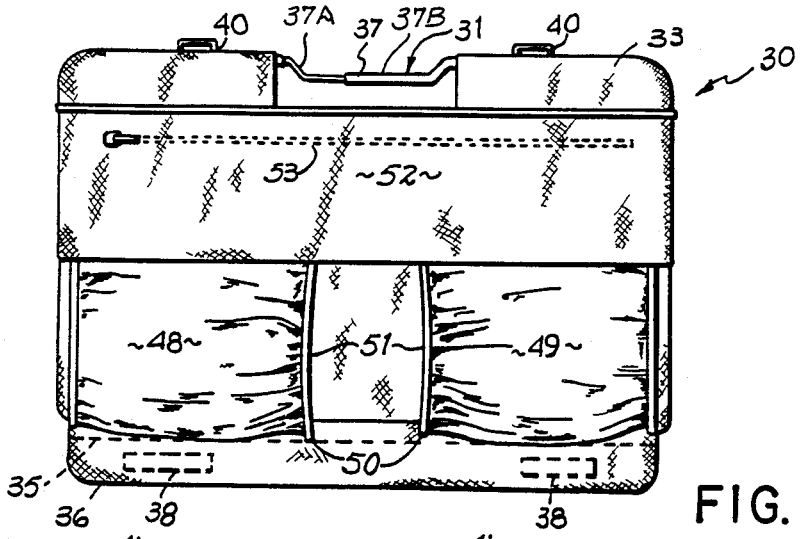
FIG. 3 is an elevational view of one side of the divider.
Figure 4:
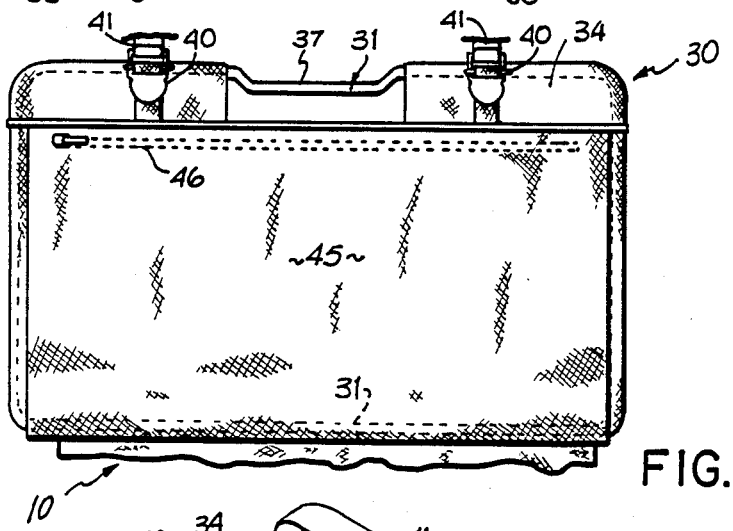
FIG. 4 is an elevational view of the other side of the divider.
Figure 5:
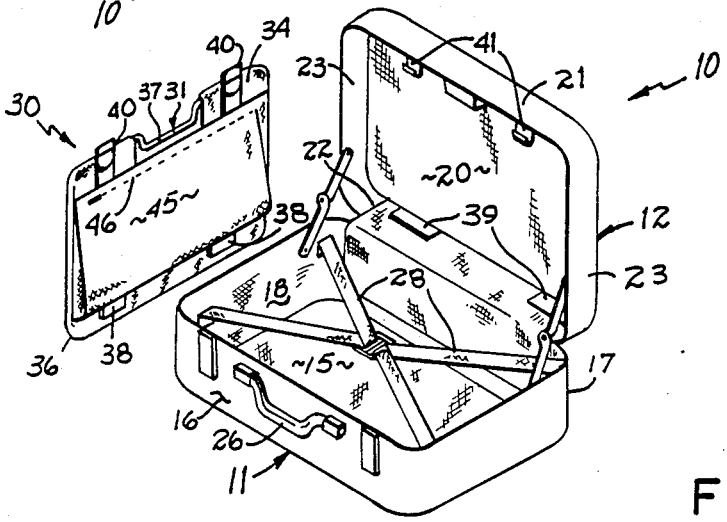
FIG. 5 is a perspective view of the suitcase opened and ready for packing.

Referring to FIGS. 1 and 3, the suitcase indicated at 10 has a hollow box 11 and a hollow lid 12. The hollow box has a bottom panel 15, the bottom panel being integrally connected to a front wall 16, a rear wall 17 and side walls 18.

Similarly, the lid 12 is formed of a top panel 20, the top panel 20 being integrally joined to a front wall 21, a rear wall 22 and side walls 23.

The rear walls 17 and 22 have hinges 25 interconnecting them so as to hinge the lid 12 to the box 11. A handle 26 is fixed to the front wall 16 of the box 11 for the purpose of carrying the suitcase. In the box, conventional expandable straps 28 are provided for protecting the clothes from being jumbled during handling.

Extending across the lid 12 is a divider 30. A rod formed as a rectangular frame 31 imparts rigidity to the divider. A two-ply fabric 33 and 34 is wrapped around the frame 31. A portion 37 of the frame 31 is exposed and can be used as a handle to carry the divider as an independent unit. To this end, the frame 31 is preferrably formed from spring steel wire 37A (approximately $\frac{1}{8}''$ diameter) encased in a vinyl extrusion 37B (approximately $\frac{3}{8}''$ diameter). The vinyl encased wire provides relative comfort as a handle.

A stiffener 35 is stitched into a free flap 36 of the two-ply fabric. Two Velcro (hook and loop) strips 38 are secured to the fabric overlying the stiffener 35. Corresponding mating Velcro strips 39 are secured to the rear wall 22 of the lid 12. By attaching the stiffening strip 35 to the lid rear wall, one edge of the divider is removably secured to the lid. The opposite edge of the divider has loops or rings 40. These loops or rings cooperate with a pair of hooks 41 on the edge of the front wall 21 of the lid whereby to hold the divider in its position extending across the lid. In this fashion the divider holds the articles of clothing that are packed in the lid securely in place against jumbling through handling.

On one side of the divider facing the box is a gusseted pocket 45. Preferably, that pocket has a zipper 46 across its top edge. The size and gusseting of the pocket make it adaptable for shirts or a sweater or the like.

On the opposite side of the divider are two gathered pockets 48 and 49, the pockets having elastic in the open edges 50 that face each other, the openings having a hem 51 to receive the elastic. These pockets are adapted to receive shoes and to maintain the dirty soles of the shoes away from the clothing in the lid. The pockets 48 and 49 cover the lower half of the divider. The upper half of the divider is covered by a pocket 52 having a zipper 53. In smaller sizes (22" and 24") suitcases, pocket 52 functions as a man's tie pocket or ladies' accessory pocket. In the two larger sizes (27" and 30"), that pocket is enlarged proportionately with side gussets that allow for greater packing capacity. For example, two or more folded men's shirts can be packed in the pocket. Thus the pocket is similar to pocket 45.

In operation, the divider can easily be removed from the lid by removing the loops from the hooks and the detachable Velcro fasteners. Thus removed, it is easy to pack the shoes, shirts and accessories into the respective pockets. The divider then is easily returned to the lid by reattaching the separable fasteners. In the meantime, of course, the box has been packed and the lid has been packed with the remaining garments. The divider holds the garments in the lid 12 and the expandable straps hold the garments snugly in the box 11. In this fashion, the suitcase is packed and is ready for travel and for abuse by even the most zealous baggage handlers.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A suitcase comprising, a hollow box, a hollow lid hinged to said box, a divider including means for removably hinging said divider to one of said box and lid, said divider having multiple pockets on each side thereof for clothing articles and accessories, said divider comprising:

a generally rectangular frame, a two-ply fabric stretched across said frame, the lower half of one of said sides of said divider having two shoe pockets with facing openings, said openings being gathered and having a hem containing elastic, a zippered pocket above said shoe pockets, and a gusseted zippered pocket on the side of said divider opposite said shoe pockets.

2. A suitcase comprising, a hollow box, a hollow lid hinged to said box, a divider including means for removably hinging said divider to one of said box and lid, said divider having multiple pockets on each side thereof for clothing articles and accessories, said divider comprising:

a generally rectangular frame of a steel wire encased in vinyl, a two-ply fabric stretched across said frame, said fabric having a central opening at the top of said divider to expose said wire to form a carrying handle, and said pockets being secured to said two-ply fabric.

* * * * *